US009604815B2

(12) United States Patent
Naitou et al.

(10) Patent No.: US 9,604,815 B2
(45) Date of Patent: Mar. 28, 2017

(54) SHEET FOLDING DEVICE

(71) Applicant: RISO KAGAKU CORPORATION, Tokyo (JP)

(72) Inventors: Taku Naitou, Ibaraki (JP); Akinori Maekawa, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 437 days.

(21) Appl. No.: 14/183,086

(22) Filed: Feb. 18, 2014

(65) Prior Publication Data

US 2014/0243180 A1 Aug. 28, 2014

(30) Foreign Application Priority Data

Feb. 22, 2013 (JP) ..... 2013-032968

(51) Int. Cl.
*B65H 45/00* (2006.01)
*B65H 45/04* (2006.01)
*B65H 45/14* (2006.01)

(52) U.S. Cl.
CPC ..... *B65H 45/04* (2013.01); *B65H 45/144* (2013.01); *B65H 2301/5122* (2013.01)

(58) Field of Classification Search
CPC ..... B65H 45/14; B65H 45/04; B65H 45/142; B65H 45/144
(Continued)

(56) References Cited

U.S. PATENT DOCUMENTS 4,270,909 A * 6/1981 Ireland ..... B31B 19/26 493/245
4,359,217 A * 11/1982 Roller ..... B65H 5/06 271/186
(Continued)

FOREIGN PATENT DOCUMENTS

EP 0783976 A2 7/1997
JP 52-12484 3/1977
(Continued)

OTHER PUBLICATIONS

Search Report issued in European Application No. 14155164.8 dated Jun. 27, 2014, seven (7) pages.
(Continued)

*Primary Examiner* — Andrew M Tecco
*Assistant Examiner* — Chelsea Stinson
(74) *Attorney, Agent, or Firm* — Greenblum & Bernstein, P.L.C.

(57) ABSTRACT

A sheet folding device includes: a sheet receiving unit with a pair of guide plates to restrict opposite sides of one or a plurality of stacked sheets and a striking portion to be struck by leading ends of the introduced sheets; a roller group to introduce the sheets into the sheet receiving unit, strike the introduced sheets on the striking portion to form a bent portion on the sheets, and nip and fold the formed bent portion and discharge the sheets from the sheet receiving unit; and a curve forming unit to form a curved portion on the sheets, at a position closer to the leading ends of the sheets than a position where the bent portion to be folded by the roller group is formed, the curved portion being curved in a width direction perpendicular to a direction of transfer of the sheets.

4 Claims, 7 Drawing Sheets

(58) Field of Classification Search
USPC ..... 493/454
See application file for complete search history.

(56) References Cited

U.S. PATENT DOCUMENTS

| | | | | | |
|---|---|---|---|---|---|
| 4,898,570 | A * | 2/1990 | Luperti | B65H 29/66 | 270/45 |
| 4,917,662 | A * | 4/1990 | Gombault | B41F 13/60 | 493/416 |
| 4,985,013 | A * | 1/1991 | van der Werff | B41F 13/60 | 493/435 |
| 5,183,246 | A * | 2/1993 | Edwards | B65H 29/62 | 270/32 |
| 5,265,864 | A * | 11/1993 | Roux | B65H 15/00 | 271/186 |
| 5,280,901 | A * | 1/1994 | Smith | B65H 29/70 | 271/188 |
| 5,425,696 | A * | 6/1995 | Hara | B65H 45/20 | 493/412 |
| 5,437,596 | A * | 8/1995 | Bogdan | B65H 45/144 | 493/420 |
| 5,445,368 | A * | 8/1995 | Lester | B65H 29/145 | 270/59 |
| 5,766,122 | A * | 6/1998 | Hamilton | B65H 45/148 | 493/420 |
| 5,992,132 | A * | 11/1999 | Auerbach | B43M 3/045 | 493/259 |
| 7,326,166 | B2 * | 2/2008 | Sytema | B65H 45/14 | 493/419 |
| 7,389,624 | B2 * | 6/2008 | Henry | B43M 3/045 | 53/381.5 |
| 8,210,513 | B2 * | 7/2012 | Latvakangas | B42C 11/02 | 270/58.07 |
| 8,419,603 | B2 * | 4/2013 | Terlau | B65H 29/66 | 493/419 |
| 8,715,149 | B2 * | 5/2014 | Izumichi | B65H 45/142 | 493/442 |
| 2006/0148630 | A1 * | 7/2006 | Sytema | B65H 45/14 | 493/434 |
| 2007/0125045 | A1 * | 6/2007 | Sytema | B43M 3/045 | 53/460 |
| 2008/0302068 | A1 * | 12/2008 | Ponti | B43M 3/045 | 53/569 |
| 2010/0021269 | A1 * | 1/2010 | Latvakangas | B42C 11/02 | 412/19 |
| 2012/0004085 | A1 * | 1/2012 | Smith | B65H 45/145 | 493/421 |
| 2014/0196414 | A1 * | 7/2014 | Schempp | B43M 3/00 | 53/492 |

FOREIGN PATENT DOCUMENTS

| | | |
|---|---|---|
| JP | 63-161263 | 10/1988 |
| JP | 6-219081 | 8/1994 |
| JP | 2002-3050 | 1/2002 |
| JP | 2007-261777 | 10/2007 |
| JP | 2009-286522 A | 12/2009 |

OTHER PUBLICATIONS

Japanese Office Action for JP App. No. 2013-032968 mailed on Oct. 25, 2016.

* cited by examiner

FIG. 11

76

| TYPE OF ENVELOPE SHEET | TYPE OF DOCUMENT SHEET | TYPE OF FOLD OF DOCUMENT SHEET | NUMBER OF DOCUMENT SHEETS | PROTRUDING AMOUNT |
|---|---|---|---|---|
| ENVELOPE SHEET A | SHEET α | HALF FOLD | 1 | X11 |
| | | | 2 | X12 |
| | | | ... | ... |
| | | TRI FOLD | 1 | X21 |
| | | | 2 | X22 |
| | | | ... | ... |
| | | ... | ... | ... |
| | SHEET β | HALF FOLD | 1 | X31 |
| | | | 2 | X32 |
| | | | ... | ... |
| | | TRI FOLD | 1 | X41 |
| | | | 2 | X42 |
| | | | ... | ... |
| | | ... | ... | ... |
| | ... | ... | ... | ... |
| ... | ... | ... | ... | ... |

SHEET FOLDING DEVICE

CROSS REFERENCE TO RELATED APPLICATION

This application is based upon and claims the benefit of priority from the prior Japanese Patent Application No. 2013-032968, filed on Feb. 22, 2013, the entire contents of which are incorporated herein by reference.

BACKGROUND

1. Technical Field

The present invention relates to a sheet folding device for folding sheets.

2. Related Art

There is a sheet folding device which folds a sheet by striking the leading end of the sheet on a striking member to bend the sheet and by nipping the bent portion with rollers.

In such a sheet folding device, when the leading end of a sheet strikes the striking member and the sheet is further transferred forward to be bent, buckling of the sheet sometimes occurs in the middle of the transferring path to the striking member. When a sheet buckles, the folding position of the sheet is displaced by the length of the buckling.

In view of this, Japanese Patent Application Publication No. 2009-286522 proposes a sheet folding device with stoppers (striking members) each having a flat portion and an inclined portion. In this sheet folding device, the inclined portion guides and strikes the leading end of a sheet onto the flat portion in a limited range between guide plates in a transferring path. In this way, the position of the leading end of the sheet is restricted, thus preventing the occurrence of buckling of a leading end portion of the sheet.

SUMMARY

Meanwhile, the occurrence of buckling cannot be prevented adequately by only restricting the position of the leading end of a sheet when it strikes striking members as the device of Japanese Patent Application Publication No. 2009-286522 does. The possibility of the occurrence of buckling is high particularly when the number of overlapping of sheets to be folded is small or when a low-stiffness sheet is to be folded. For this reason, the device of Japanese Patent Application Publication No. 2009-286522 still lacks an ability to produce a sufficient effect of reducing displacement of the folding position due to buckling.

An object of the present invention is to provide a sheet folding device capable of reducing displacement of the folding position of a sheet.

A sheet folding device in accordance with some embodiments includes: a sheet receiving unit including a pair of guide plates configured to restrict opposite sides, in a thickness direction, of one or a plurality of stacked sheets introduced into the sheet receiving unit and a striking portion configured to be struck by leading ends of the sheets as introduced; a roller group configured to introduce the sheets into the sheet receiving unit, strike the sheets as introduced on the striking portion to form a bent portion on the sheets, and nip and fold the bent portion as formed and discharge the sheets from the sheet receiving unit; and a curve forming unit configured to form a curved portion on the sheets introduced in the sheet receiving unit, at a position closer to the leading ends of the sheets than a position where the bent portion to be folded by the roller group is formed.

The curved portion is curved in a width direction perpendicular to a direction of transfer of the sheets.

According to the above configuration, a curved portion curved in the width direction perpendicular to the direction of transfer is formed on the sheets introduced in the sheet receiving unit at a position which is closer to the leading ends of the sheets than is the position where the bent portion to be folded by the roller group is formed. In this way, the stiffness of the sheets is enhanced, thereby making it possible to reduce the occurrence of buckling after the sheets strike the striking portion. As a result, displacement of the folding position of the sheets can be reduced.

The curve forming unit may include at least one first protruding member protruding from one of the pair of guide plates toward the other guide plate by a first protruding amount, and having an inclined surface getting closer to the other guide plate as extending toward a downstream side in the direction of transfer of the sheets, and at least one second protruding member protruding from the other guide plate toward the one guide plate by a second protruding amount, and having an inclined surface getting closer to the one guide plate as extending toward the downstream side in the direction of transfer of the sheets. The first protruding member and the second protruding member may be arranged alternately at an interval in the width direction.

According to the above configuration, the first protruding member and the second protruding member with their inclined surfaces can introduced the sheets smoothly and also curve the sheets to enhance the stiffness thereof.

At least one of the first protruding member or the second protruding member may have flexibility.

According to the above configuration, the first protruding member and the second protruding member can be prevented from obstructing the sheet introduction even when a thick sheet stack is to be introduced into the sheet receiving unit.

The sheet folding device may further include: an adjusting unit configured to adjust at least one protruding amount of the first protruding amount or the second protruding amount; and a controlling unit configured to control the adjusting unit to adjust the at least one protruding amount on a basis of at least one of a type of the sheets or a number of overlapping of the sheets to be introduced into the sheet receiving unit.

According to the above configuration, the protruding amount of at least one of the first protruding member or the second protruding member from the corresponding guide plate is adjusted on the basis of at least one of the type of the sheets or the number of overlapping of the sheets to be introduced into the sheet receiving unit. Accordingly, it is possible to perform stiffness enhancement suitable to the conditions of the sheets to be introduced into the sheet receiving unit.

BRIEF DESCRIPTION OF DRAWINGS

FIG. 11 is a diagram showing a protruding amount table.

DETAILED DESCRIPTION

Figure 1:
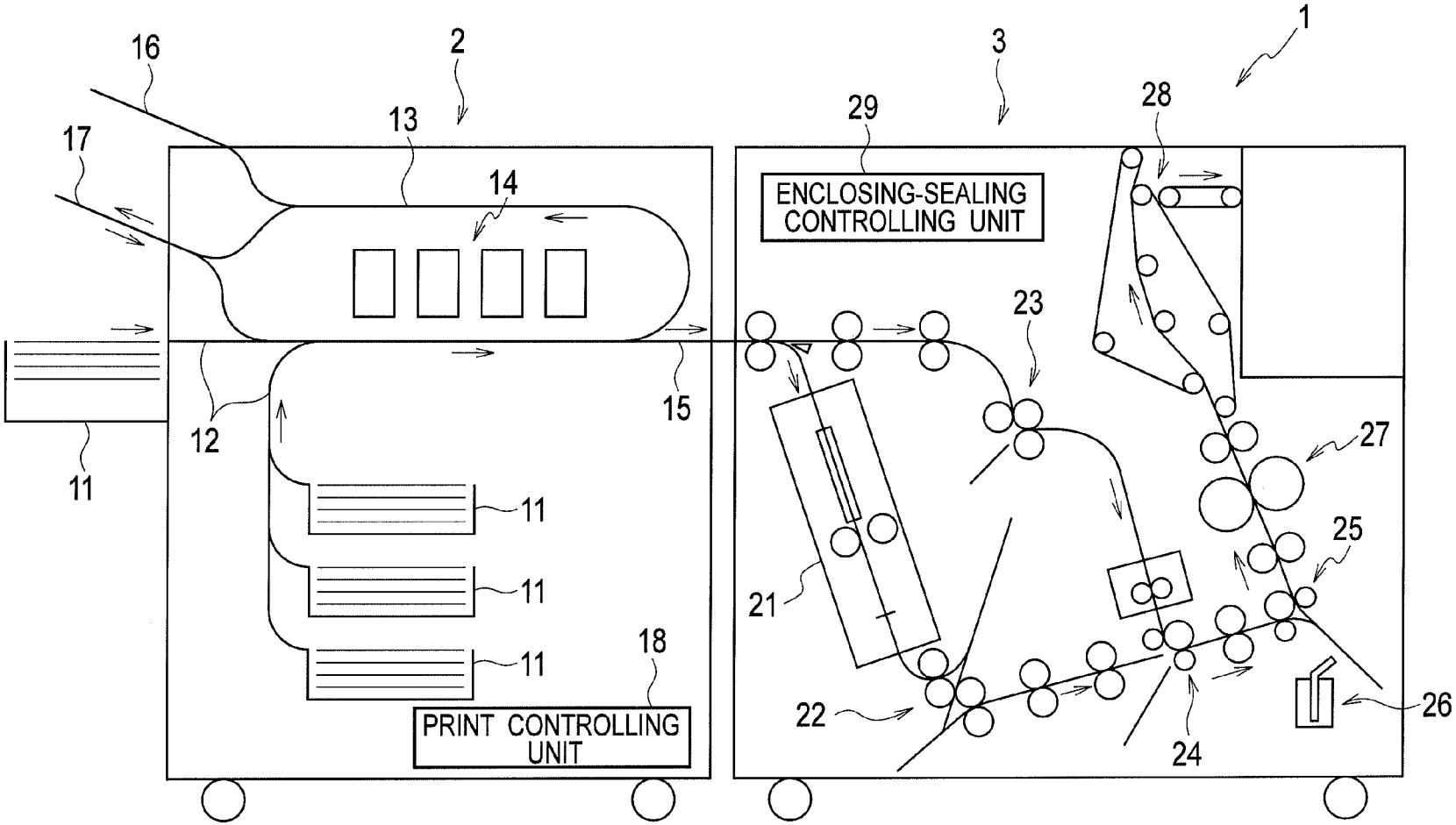
FIG. 1 is a schematic configuration diagram of a sealed letter making system including an enclosing-sealing apparatus provided with a sheet folding device according to a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Hereinbelow, embodiments of the present invention will be described with reference to the drawings. The same or similar portions and constituent components in the drawings are denoted by the same or similar reference signs. It is to be noted that the drawings are schematic and differ from the actual ones. Moreover, some drawings naturally include portions with different dimensional relations and ratios. Note that in FIGS. 2, 4, and 7 to 9, right, left, upper, and lower sides are denoted by RT, LT, UP, and DN, respectively.

First Embodiment

FIG. 1 is a schematic configuration diagram of a sealed letter making system including an enclosing-sealing apparatus provided with a sheet folding device according to a first embodiment of the present invention. As shown in FIG. 1, a sealed letter making system 1 of the first embodiment includes a printing machine 2 and an enclosing-sealing apparatus 3.

The printing machine 2 is configured to print an envelope sheet and a content sheet and deliver them to the enclosing-sealing apparatus 3. The printing machine 2 includes: multiple paper feed units 11 capable of storing multiple types of sheets (envelope sheets and content sheets) inside housings, on side surfaces, etc.; a looped transferring path 13 configured to transfer a sheet from an introducing path 12; a printing unit 14 including multiple inkjet heads; a delivering path 15 configured to deliver a sheet to the enclosing-sealing apparatus; a discharging path 16 configured to discharge a sheet to the outside of the loop; a switchback path 17 configured to reverse when receiving a sheet transferred through the transferring path 13 and bring the sheet back onto the transferring path 13 to thereby turn the sheet upside down; and a print controlling unit 18 configured to control the whole printing machine 2. The print controlling unit 18 is formed by a CPU, a RAM, a ROM, a hard disk drive, and so on.

Here, the envelope sheet is a sheet used exclusively for the sealed letter making in the enclosing-sealing apparatus 3. The envelope sheet will be formed into an envelope shape by being folded in three. The envelope sheet is previously coated in prescribed areas with a remoistenable glue which becomes adhesive when water is attached thereto and with a pressure-sensitive adhesive agent which adheres to a matter when pressed thereagainst.

The enclosing-sealing apparatus 3 is configured to make a sealed letter by forming an envelope from an envelope sheet printed by the printing machine 2 and by placing content sheets printed by the printing machine 2 into the envelope. The enclosing-sealing apparatus 3 includes: an aligning unit 21 configured to align multiple printed content sheets; a document folding unit 22 configured to fold the aligned content sheets in two or three, for example; a pre-folding unit 23 configured to pre-fold an envelope sheet if necessary; a wrapping unit 24 configured to fold the envelope sheet and hold the content sheets therein; an enclosing unit 25 configured to form an envelope by folding a flap portion of the envelope sheet holding the content sheets; a water applying unit 26 configured to apply water to the remoistenable glue on the envelope sheet; a sealing unit 27 configured to seal the envelope; a discharging unit 28 configured to discharge the envelope; and an enclosing-sealing controlling unit 29 configured to control the whole enclosing-sealing apparatus 3. The enclosing-sealing controlling unit 29 is formed by a CPU, a RAM, a ROM, a hard disk drive, and so on.

Figure 2:
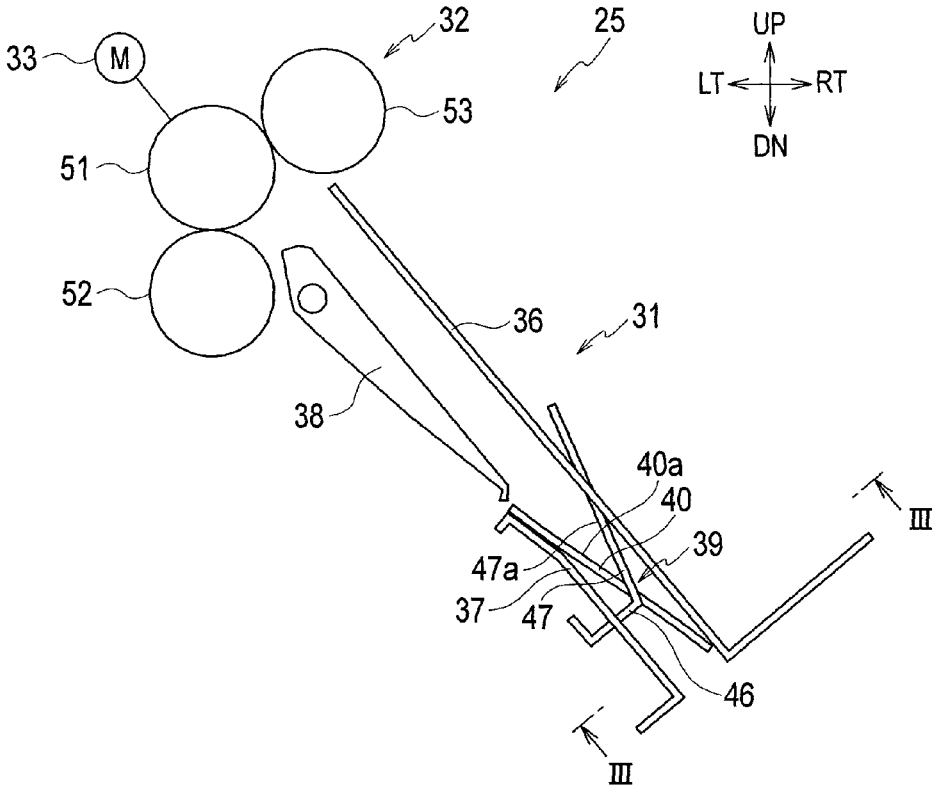
FIG. 2 is a configuration diagram of an enclosing unit according to the first embodiment.

The enclosing-sealing apparatus 3 is equipped with the sheet folding device according to this embodiment as the enclosing unit 25. This enclosing unit 25 will be described in detail. As shown in FIG. 2, the enclosing unit 25 includes a sheet receiving unit 31, a roller group 32, and a roller motor 33.

Figure 3:
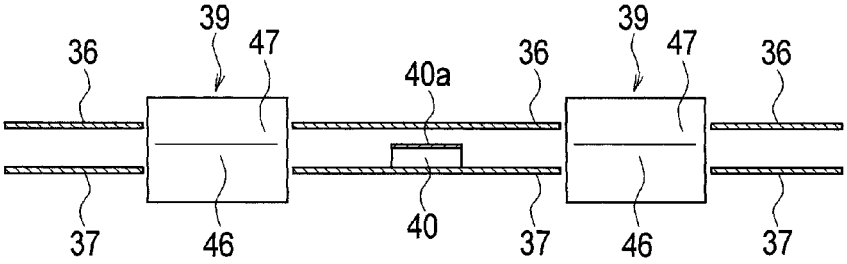
FIG. 3 is a cross-sectional view taken along line in FIG. 2.

The sheet receiving unit 31 is where the envelope sheet that is caused to hold the content sheets therein in the wrapping unit 24 is temporarily introduced. As shown in FIGS. 2 and 3, the sheet receiving unit 31 includes guide plates 36, 37, and 38, two leading-end restrictors 39, and a stiffness enhancing member 40.

The guide plates 36, 37, and 38 are configured to restrict the opposite sides, in the thickness direction, of the envelope sheet holding the content sheets therein and introduced in the sheet receiving unit 31. The guide plate 36 restricts a surface of the envelope sheet introduced in the sheet receiving unit 31, the surface facing an upper right side in the drawing. The guide plates 37 and 38 are provided in parallel with the guide plate 36 and face the guide plate 36, and are configured to restrict a surface of the envelope sheet introduced in the sheet receiving unit 31, the surface facing a lower left side in the drawing. The guide plate 36 corresponds to one (or the other) guide plate, and the guide plates 37 and 38 correspond to the other (or one) guide plate.

The two leading-end restrictors 39 are arranged in a leading end portion of the sheet receiving unit 31 with a prescribed gap therebetween in the width direction of the introduced envelope sheet (in the direction normal to the plane of FIG. 2 and in the left-right direction in the plane of FIG. 3). Each leading-end restrictor 39 has a striking portion 46 and an inclined portion 47.

The striking portion 46 forms a striking surface to be struck by the leading end of the introduced envelope sheet. The striking portion 46 protrudes from the guide plate 37 toward the guide plate 36 and is provided substantially perpendicularly to the guide plates 36 and 37. The height of the striking portion 46 from the guide plate 37 is smaller than the gap between the guide plates 36 and 37.

The inclined portion 47 is configured to enhance the stiffness of the introduced envelope sheet holding the content sheets therein by curving the envelope sheet in the width direction in cooperation with the stiffness enhancing member 40. The inclined portion 47 is formed to be inclined from the guide plate 36 side end of the striking portion 46 toward the guide plate 36. In other words, the inclined portion 47 is formed to protrude from the guide plate 36 toward the guide plate 37 by a first protruding amount. The inclined portion 47 has an inclined surface 47*a* which gets closer to the guide plate 37 as extending toward a downstream side in the direction of transfer for sheet introduction. Here, in sheet introduction, the sheets are transferred from an upper left side to a lower right side in FIG. 2. The inclined portion 47 corresponds to a first protruding member or a second protruding member.

The stiffness enhancing member 40 is configured to enhance the stiffness of the introduced envelope sheet by curving it in the width direction in cooperation with the inclined portions 47 of the two leading-end restrictors 39. The stiffness enhancing member 40 is arranged around the intermediate point between the two leading-end restrictors 39 in the width direction. The stiffness enhancing member 40 is formed in the leading end portion of the sheet receiving unit 31. The stiffness enhancing member 40 is formed to protrude from the guide plate 37 toward the guide plate 36 by a second protruding amount, and has an inclined surface 40*a* which gets closer to the guide plate 36 as extending toward the downstream side in the direction of transfer for sheet introduction. The stiffness enhancing member 40 is formed of a flexible member such as a Mylar member. The stiffness enhancing member 40 corresponds to the first protruding member or the second protruding member. The stiffness enhancing member 40 and the above-mentioned two inclined portions 47 serve as a curve forming unit.

The roller group 32 is configured to introduce the envelope sheet holding the content sheets therein into the sheet receiving unit 31, nip and fold a bent portion of the envelope sheet formed by striking the envelope sheet on the striking portion 46 of each leading-end restrictor 39, and discharge the envelope surrounding the content sheets. The roller group 32 is arranged near an introducing port of the sheet receiving unit 31. The roller group 32 includes a main folding roller 51, an introducing roller 52, and a discharging roller 53.

The main folding roller 51 is configured to be capable of being rotated counterclockwise in FIG. 2 by the roller motor 33. The introducing roller 52 is provided under the main folding roller 51 in such a way as to be capable of being driven by the main folding roller 51. The main folding roller 51 and the introducing roller 52 nip the envelope sheet holding the content sheets therein and transferred from the left side and introduce the envelope sheet into the sheet receiving unit 31 to strike it on the striking portions 46, thereby forming a bend on the envelope sheet near the introducing port of the sheet receiving unit 31. The discharging roller 53 is provided on an upper right side of the main folding roller 51 in such a way as to be capable of being driven by the main folding roller 51. The main folding roller 51 and the discharging roller 53 nip and fold the bent portion formed on the envelope sheet, and discharge the envelope surrounding the content sheets from the sheet receiving unit 31.

Next, the operation of the sealed letter making system 1 will be described.

The printing machine 2 starts a printing operation upon receipt of print jobs for making a sealed letter from an external personal computer (PC), for example.

As the printing operation starts, content sheets of one letter are fed in turn from one of the multiple paper feed units 11 and printed in turn in the printing unit 14. The printed content sheets are delivered to the enclosing-sealing apparatus 3 through the delivering path 15. Moreover, after feeding the content sheets of one letter, an envelope sheet stored in one of the multiple paper feed units 11 is fed, printed in turn in the printing unit 14, and delivered to the enclosing-sealing apparatus 3 through the delivering path 15. Note that the content sheets and the envelope sheet may be transferred through the loop by using the switchback path 17. In this way, the content sheets and the envelop sheet can be printed on both sides.

Once the content sheets and the envelope sheet printed in the printing machine 2 are delivered to the enclosing-sealing apparatus 3, the enclosing-sealing apparatus 3 performs a sealed letter making operation. In the enclosing-sealing apparatus 3, the content sheets of one letter delivered from the printing machine 2 are aligned in the aligning unit 21 and folded in two or three, for example, in the document folding unit 22. On the other hand, the envelope sheet delivered to the enclosing-sealing apparatus 3 is pre-folded in the pre-folding unit 23 if necessary and transferred to the wrapping unit 24. In the wrapping unit 24, the envelop sheet is folded and is caused to hold therein the content sheets folded in the document folding unit 22.

Then, in the enclosing unit 25, the flap portion of the envelope sheet holding the content sheets therein is folded. In this step, the water applying unit 26 applies water to the remoistenable glue on the envelope sheet. As a result, when the envelope sheet is folded in the enclosing unit 25, the remoistenable glue to which water is applied adheres to the opposite surface, thereby forming an envelope in which the content sheets are inserted. The opposite end portions of the envelope thus formed are pressed and bonded to each other in the sealing unit 27, thereby sealing the envelope. As a result, a sealed letter is made. The sealed letter thus made is discharged by the discharging unit 28.

Next, details of the operation of the enclosing unit 25 in the above-described sealed letter making operation of the enclosing-sealing apparatus 3 will be described. Note that description of the application of water to the envelope sheet by the water applying unit 26 will be omitted.

When an envelope sheet P1 holding content sheets P2 therein is transferred from the wrapping unit 24, the main folding roller 51 and the introducing roller 52 of the enclosing unit 25 nip and transfer the envelope sheet P1. As a result, the envelope sheet P1 holding the content sheets P2 therein enters the sheet receiving unit 31. The envelope sheet P1 having entered the sheet receiving unit 31 moves forward while being guided by the guide plates 36 and 38.

Figure 4:
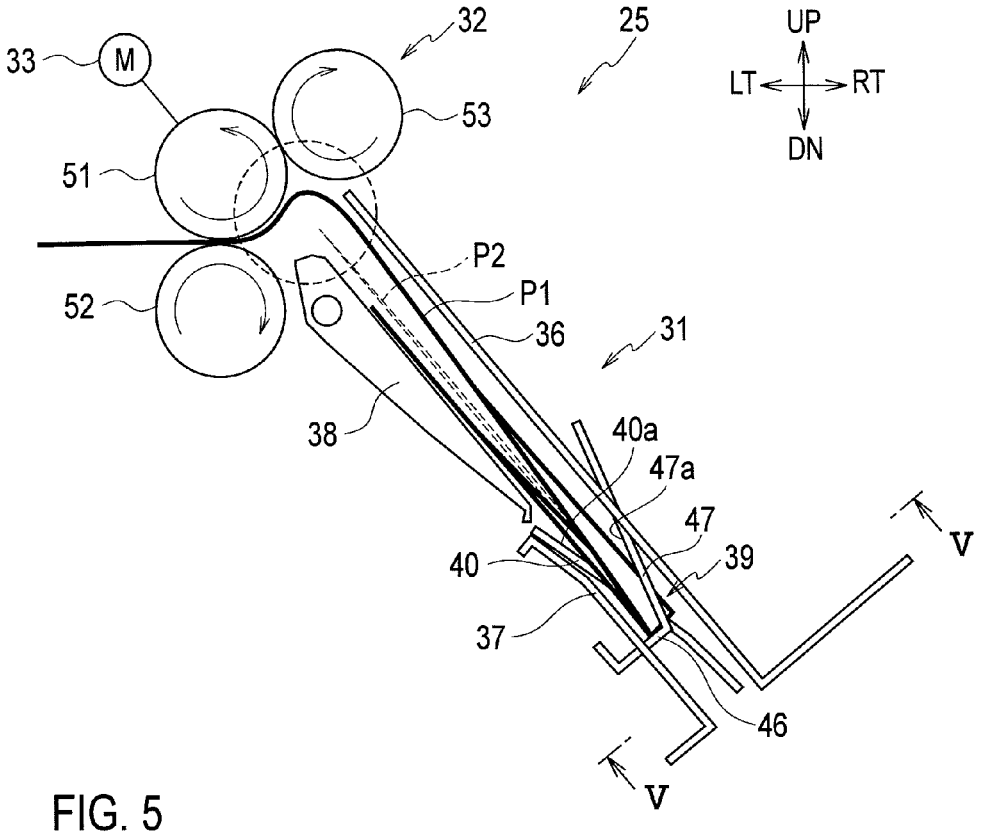
FIG. 4 is a view showing an example of a state where an envelope sheet strikes striking portions.

Then, as shown in FIG. 4, the leading end of the envelope sheet P1 strikes the striking portions 46 of the leading-end restrictors 39. Here, a center portion of the envelope sheet P1 in the width direction is raised toward the guide plate 36 along the inclined surface 40*a* of the stiffness enhancing member 40, while the opposite end portions of the envelope sheet P1 in the width direction are lowered toward the guide plate 37 along the inclined surfaces 47*a* of the leading-end restrictors 39.

Figure 5:
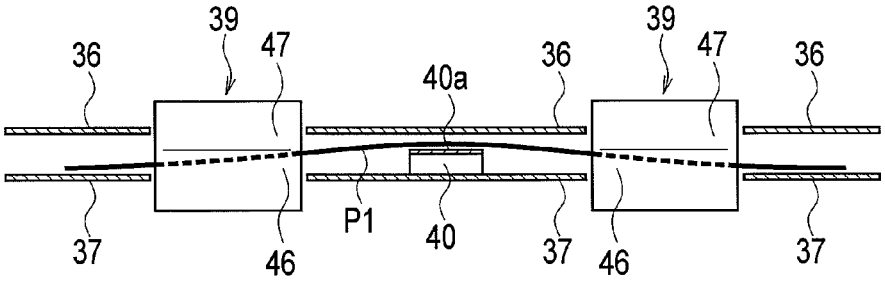
FIG. 5 is a cross-sectional view taken along line V-V in FIG. 4.
Figure 6:
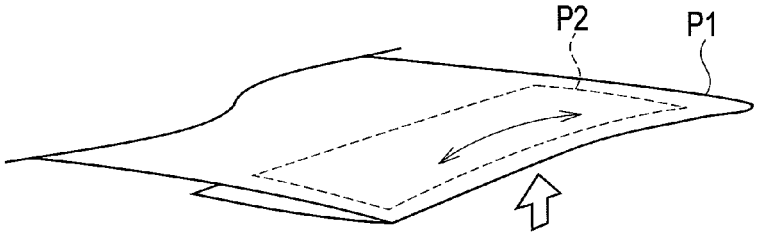
FIG. 6 is an external view of the envelope sheet in a curved state.

As a result, as shown in FIGS. 5 and 6, a leading end portion of the envelope sheet P1 is curved such that the center portion in the width direction is closer to the guide plate 36 than the opposite end portions are. This enhances the stiffness of the envelope sheet P1 and the content sheets P2 held therein.

The main folding roller 41 is kept rotationally driven even after the leading end of the envelope sheet P1 strikes the striking portions 46. As a result, as shown inside a circle of a broken line in FIG. 4, a bend is formed on the envelope sheet P1 in the direction of transfer near the introducing port of the sheet receiving unit 31, i.e. near the nipping point of the main folding roller 51 and the discharging roller 53.

As the main folding roller 51 and the discharging roller 53 nip the bent portion of the envelope sheet P1 thus formed, the envelope sheet P1 is folded by the main folding roller 51 and the discharging roller 53 and discharged from the sheet receiving unit 31. As a result, an envelope surrounding the content sheets P2 is formed, and this envelope is delivered to the sealing unit 27.

Figure 7:
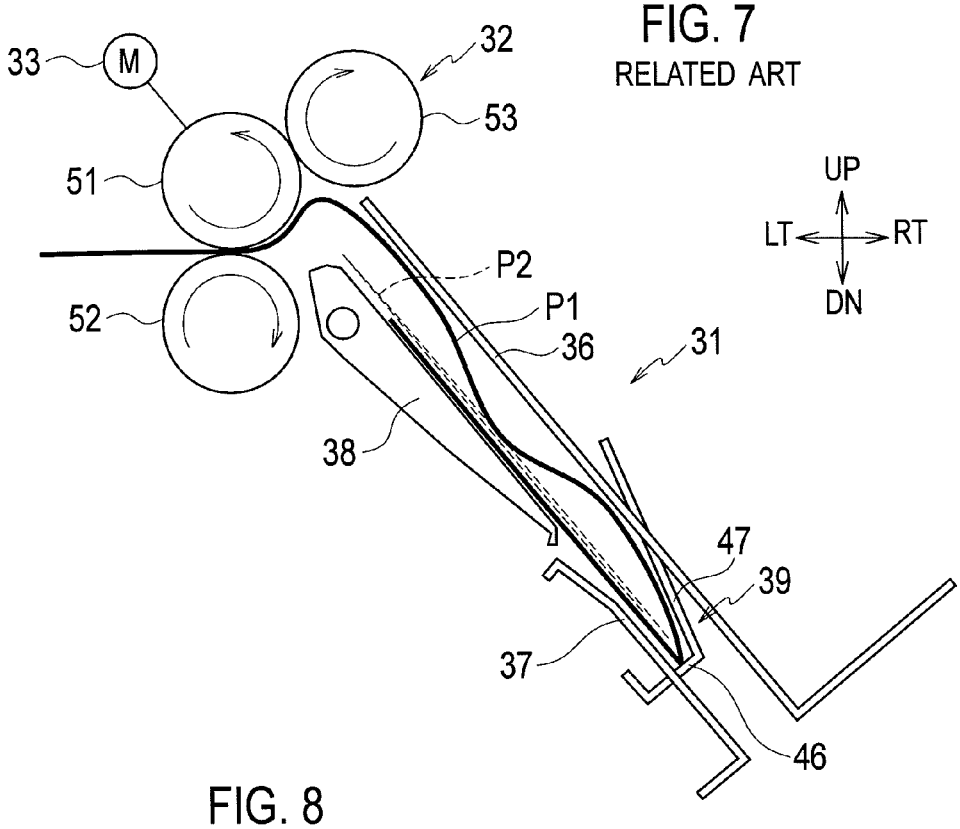
FIG. 7 RELATED ART
FIG. 7 is an explanatory view of buckling.

Meanwhile, when the stiffness enhancing member 40 is not present unlike the enclosing unit 25 in this embodiment, the envelope sheet P1 may buckle inside the sheet receiving unit 31 in some cases as shown in FIG. 7. When such buckling occurs, the position at which the envelope sheet P1 is folded by the main folding roller 51 and the discharging roller 53 is displaced from the original position by a length corresponding to the bend caused by the buckling. In contrast, in the case of the enclosing unit 25 in this embodiment, the stiffness of the envelope sheet P1 is enhanced by a curve as shown in FIGS. 4 to 6, thereby making it possible to reduce the occurrence of buckling as shown in FIG. 7.

Figure 8:
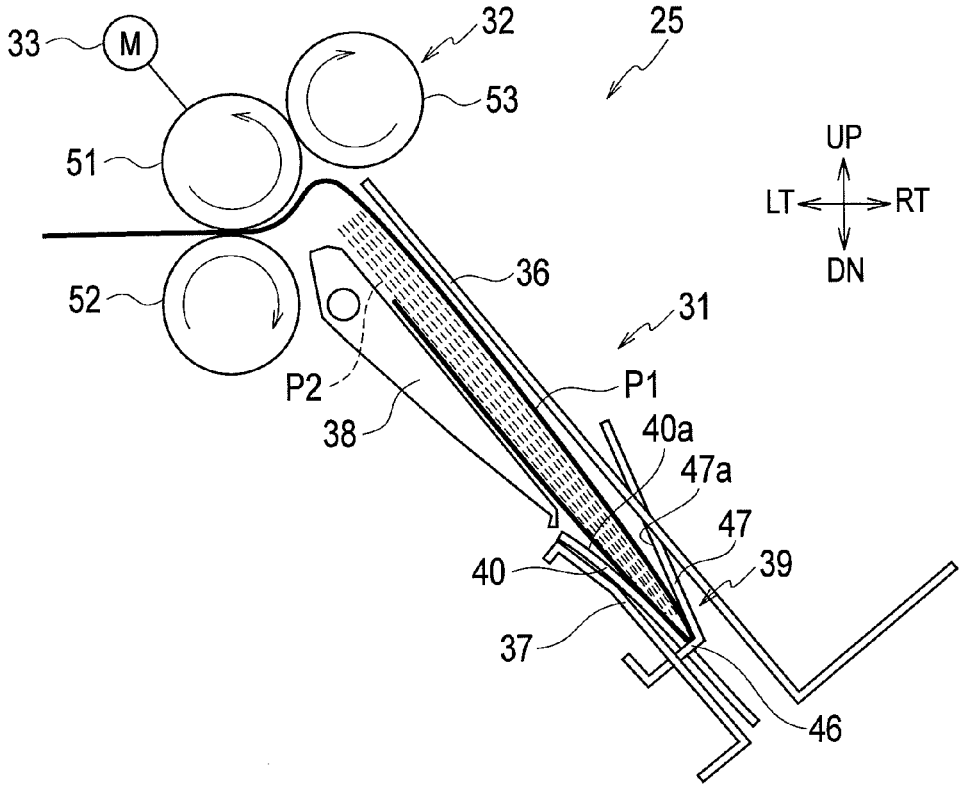
FIG. 8 is a view showing another example of the state where the envelope sheet strikes the striking portions.

Here, the example of FIGS. 4 to 6 is a case where there are relatively few content sheets P2, that is, a case where the number of overlapping of the sheets to be introduced in the sheet receiving unit 31 is relatively small. FIG. 8, in contrast, shows an example which is a case where there are relatively many content sheets P2, that is, a case where the number of overlapping of the sheets is relatively large. In this case, the stiffness enhancing member 40 is lowered toward the guide plate 37 since the stiffness enhancing member 40 is flexible. Thus, the envelope sheet P1 can strike the striking portions 46 without the stiffness enhancing member 40 obstructing the sheet transfer. Note that in the above case, the sheet stack formed of the envelope sheet P1 and the content sheets P2 is thick, thereby leaving only a small empty space in the sheet receiving unit 31. Accordingly, the possibility of the occurrence of buckling as shown in FIG. 7 is low.

As described above, in the enclosing unit 25, the stiffness enhancing member 40 and the inclined portions 47 of the two leading-end restrictors 39 curve, in the width direction, sheets (envelope sheet and content sheets) introduced in the sheet receiving unit 31. This enhances the stiffness of the sheets and thereby makes it possible to reduce the occurrence of buckling of the sheets after they strike the striking portions 46. As a result, displacement of the folding position of the envelope sheet from the original position can be reduced.

Moreover, the stiffness enhancing member 40 and the inclined portions 47 of the leading-end restrictors 39 are arranged in the leading end portion of the sheet receiving unit 31. This makes it possible to prevent the sheets from being curved in the width direction near the introducing port of the sheet receiving unit 31 where the bent portion to be folded by the main folding roller 51 and the discharging roller 53 is formed. Accordingly, the occurrence of defective folding can be suppressed.

Moreover, since the stiffness enhancing member 40 and the inclined portions 47, which are protruding members, have the inclined surfaces 40*a* and 47*a*, respectively, the sheets can be smoothly introduced and curved.

Moreover, since the stiffness enhancing member 40 is formed of a flexible member, it is possible to prevent it from obstructing the sheet transfer even in a case of transferring a thick sheet stack into the sheet receiving unit 31.

Second Embodiment

Figure 9:
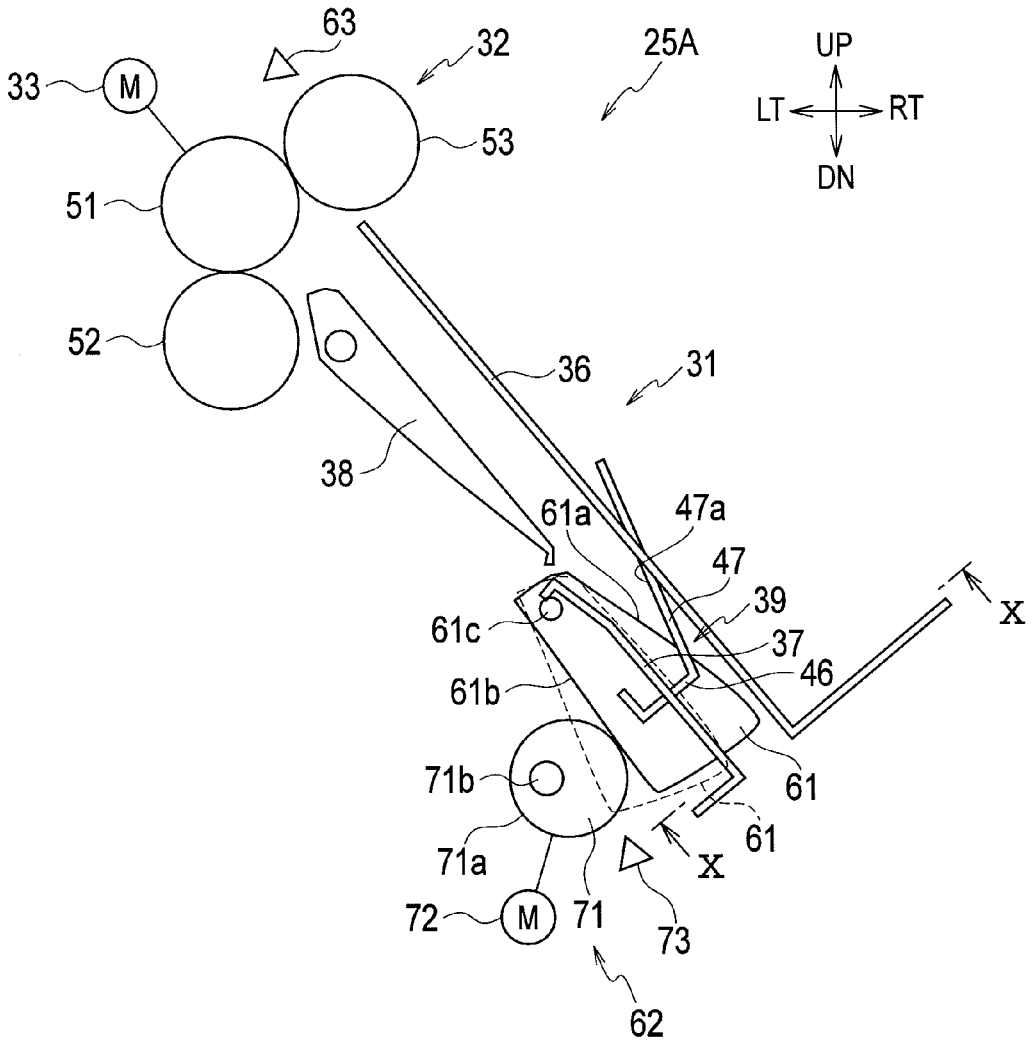
FIG. 9 is a configuration diagram of an enclosing unit according to a second embodiment.

Next, a second embodiment will be described which is the above-described embodiment with a modified enclosing unit. FIG. 9 is a configuration diagram of the enclosing unit in the second embodiment.

As shown in FIG. 9, an enclosing unit 25A in the second embodiment is the enclosing unit 25 in FIG. 2 which includes a stiffness enhancing member 61 instead of the stiffness enhancing member 40 and is provided additionally with an adjusting unit 62 and a discharge sensor 63.

Figure 10:
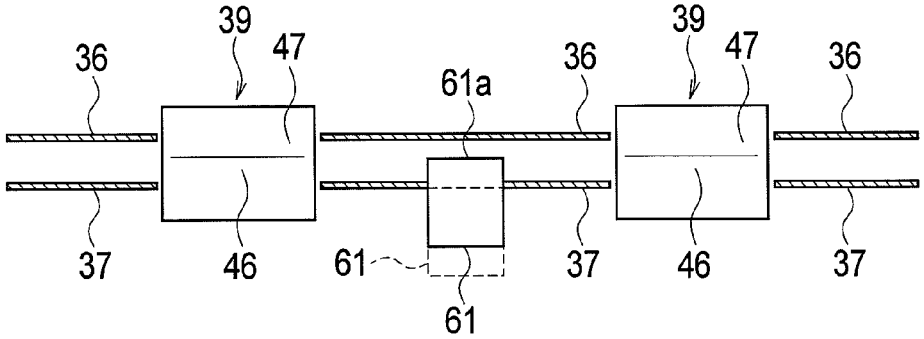
FIG. 10 is a cross-sectional view taken along line X-X in FIG. 9.

The stiffness enhancing member 61 is formed in a substantially trapezoidal shape in a front view, and has an inclined surface 61*a* which protrudes from the guide plate 37 toward the guide plate 36 and gets closer to the guide plate 36 as extending toward the downstream side in the direction of transfer for sheet introduction. A lower surface 61*b* on the opposite side from the inclined surface 61*a* is in contact with an outer peripheral surface 71*a* of a cam 71 to be described later. Moreover, the stiffness enhancing member 61 is configured to be rotatable about a rotary shaft 61*c* provided around the upper side of the trapezoid. In this way, the protruding amount (protruding height) (the second protruding amount) of the inclined surface 61*a* from the guide plate 37 can be adjusted via rotation of the cam 71. As shown in FIG. 10, the stiffness enhancing member 61 is arranged around the intermediate point between the two leading-end restrictors 39 in the width direction.

The adjusting unit 62 is configured to adjust the protruding amount of the inclined surface 61*a* of the stiffness enhancing member 61 from the guide plate 37 (hereinafter, referred to as the protruding amount of the stiffness enhancing member 61 when appropriate). The adjusting unit 62 includes the cam 71, a cam motor 72, and a stiffness-enhancing-member home position (HP) sensor 73.

The cam 71 is formed in a circular shape in the front view and arranged such that its outer peripheral surface 71*a* comes in contact with the lower surface 61*b* of the stiffness enhancing member 61. The cam 71 is configured to rotate about a rotary shaft 71*b* which is off the center of the cam 71.

The cam motor 72 is configured to rotate the rotary shaft 71*b* of the cam 71. The cam motor 72 is formed of a pulse motor. The drive of the cam motor 72 is controlled by the enclosing-sealing controlling unit 29.

The stiffness-enhancing-member HP sensor 73 is configured to detect whether or not the stiffness enhancing member 61 is in its home position, and output a detection signal to the enclosing-sealing controlling unit 29.

The discharge sensor 63 is configured to detect an envelope formed and discharged from the sheet receiving unit 31 by the main folding roller 51 and the discharging roller 53, and output a detection signal to the enclosing-sealing controlling unit 29. The discharge sensor 63 is arranged near the downstream side of the main folding roller 51 and the discharging roller 53 in the direction of transfer for sheet discharge.

Moreover, in the second embodiment, the enclosing-sealing controlling unit 29 stores therein a protruding amount table 76 shown in FIG. 11. The protruding amount table 76 holds various protruding amounts of the stiffness enhancing member 61 each associated with a combination of a type of envelope sheet, a type of content sheet, a type of fold of content sheet (half-fold, tri-fold, etc.), and a given number of content sheets per envelope.

The thickness and stiffness of a sheet stack formed of an envelope sheet and content sheets to be introduced into the sheet receiving unit 31 vary depending upon the combination of the elements included in the protruding amount table 76, which are the type of envelope sheet, the type of content sheet, the type of fold of content sheet, and the number of content sheets. Thus, the enclosing-sealing controlling unit 29 refers to the protruding amount table 76 and adjusts the protruding amount of the stiffness enhancing member 61 on the basis of a combination of the above-mentioned elements.

Next, a process for adjusting the protruding amount of the stiffness enhancing member 61 in the enclosing unit 25A will be described with reference to a flowchart in FIG. 12.

Figure 12:
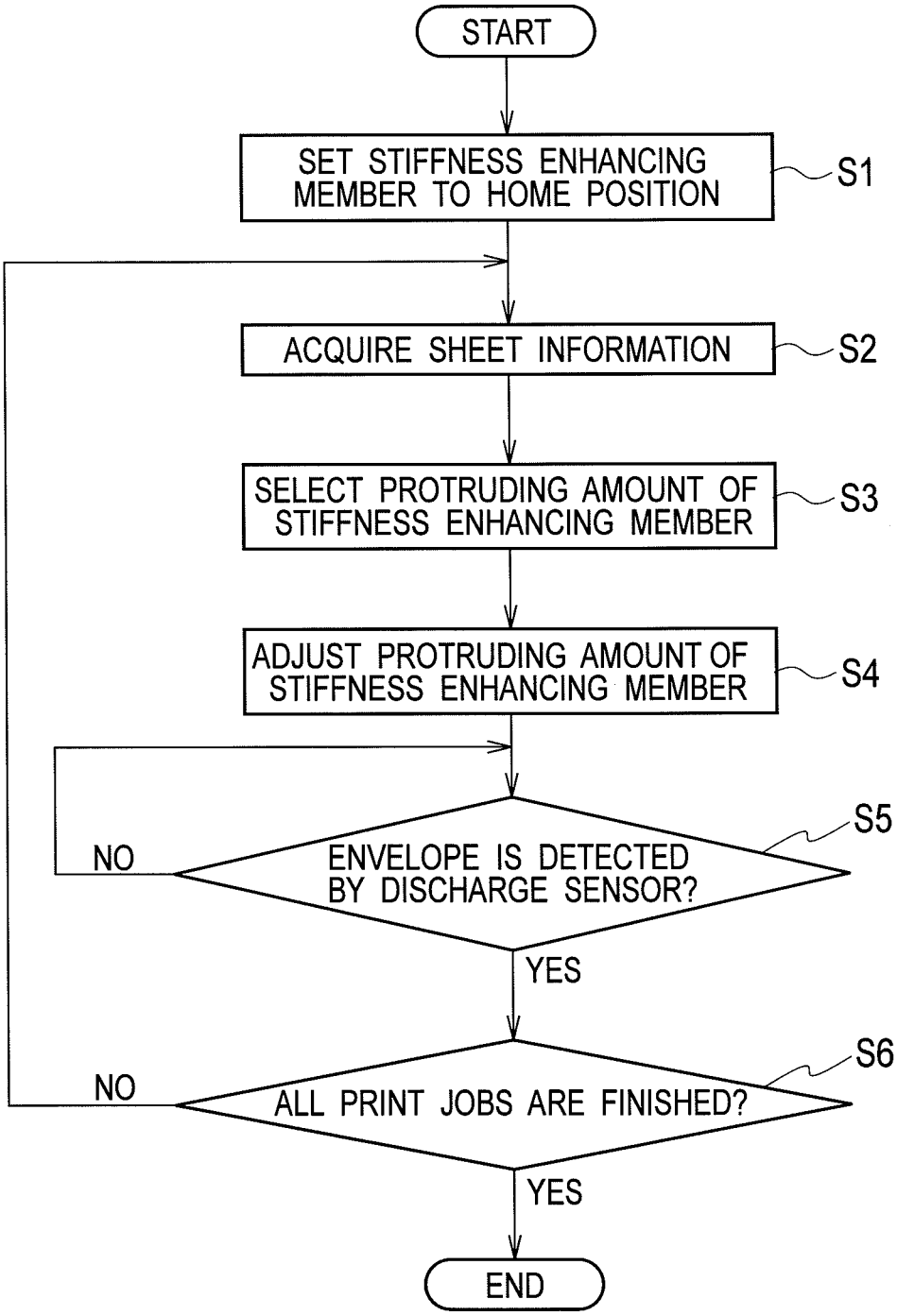
FIG. 12 is a flowchart of a process for adjusting the protruding amount of a stiffness enhancing member.

The process in the flowchart in FIG. 12 starts when the printing machine 2 receives print jobs for making a sealed letter and the enclosing-sealing controlling unit 29 is informed of initiation of the print jobs.

First, in step S1, the enclosing-sealing controlling unit 29 sets the stiffness enhancing member 61 to its home position. Specifically, the enclosing-sealing controlling unit 29 drives the cam motor 72 and then stops the cam motor 72 when receiving a detection signal from the stiffness-enhancing-member HP sensor 73.

Then, in step S2, the enclosing-sealing controlling unit 29 acquires sheet information from the print controlling unit of the printing machine 2. In this step, the print controlling unit 18 outputs sheet information acquired from the print jobs to the enclosing-sealing controlling unit 29. The sheet information includes the type of envelope sheet, the type of content sheet, and the type of fold of content sheet, and the number of content sheets per envelope.

Then, in step S3, the enclosing-sealing controlling unit 29 refers to the protruding amount table 76 and selects the protruding amount of the stiffness enhancing member 61 on the basis of the sheet information acquired in step S2.

Then, in step S4, the enclosing-sealing controlling unit 29 adjusts the protruding amount of the stiffness enhancing member 61 to the protruding amount selected in step S3. Specifically, the enclosing-sealing controlling unit 29 starts driving the cam motor 72, and then stops the cam motor 72 when the number of drive pulses reaches a value corresponding to the protruding amount selected in step S3.

The adjustment of the protruding amount of the stiffness enhancing member 61 in step S4 is performed before the envelope sheet holding the content sheets therein reaches from the wrapping unit 24 to the enclosing unit 25. When the envelope sheet holding the content sheets therein reaches the enclosing unit 25 after the protruding amount of the stiffness enhancing member 61 is adjusted, an envelope is formed in the enclosing unit 25 and the envelope is discharged as described earlier.

After step S4, the enclosing-sealing controlling unit 29 determines in step S5 whether or not the envelope is detected by the discharge sensor 63. If determining that the envelope is not yet detected by the discharge sensor 63 (step S5: NO), the enclosing-sealing controlling unit 29 repeats step S5.

If determining that the envelope is detected by the discharge sensor 63 (step S5: YES), the enclosing-sealing controlling unit 29 determines in step S6 whether or not all the print jobs are finished. If determining that there is a next print job (step S6: NO), the enclosing-sealing controlling unit 29 returns to step S2. If determining that all the print jobs are finished (step S6: YES), the enclosing-sealing controlling unit 29 ends the process.

As described above, in the second embodiment, the enclosing-sealing controlling unit 29 controls the adjusting unit 62 to adjust the protruding amount of the stiffness enhancing member 61 on the basis of a combination of the elements of the type of envelope sheet, the type of content sheet, the type of fold of content sheet, and the number of content sheets. Thus, in a case, for example, where a small number of low-stiffness sheets are to be introduced into the sheet receiving unit 31, the protruding amount of the stiffness enhancing member 61 is increased to form a large curve in the width direction of the sheets. In this way, the occurrence of buckling can be suppressed. Moreover, in a case, for example, where a thick sheet stack is to be introduced, the protruding amount of the stiffness enhancing member 61 is decreased. In this way, the stiffness enhancing member 61 can be prevented from obstructing the sheet introduction. Thus, in the second embodiment, it is possible to perform stiffness enhancement suitable to the conditions of the sheets to be introduced into the sheet receiving unit 31.

Other Embodiments

Although the present invention has been described above based on the first and second embodiments, it should not be understood that the statement and the drawings constituting part of this disclosure limit this invention. Various alternative embodiments, examples, and operation techniques become apparent to those skilled in the art from this disclosure.

The first and second embodiments have been described using the example where a sheet stack which is an envelope sheet holding content sheets therein is introduced into the sheet receiving unit 31. However, the present invention is not limited to this example. The present invention is applicable to any cases that involve introducing one or multiple stacked sheets into the sheet receiving unit 31.

Moreover, in the second embodiment, the protruding amount of the stiffness enhancing member 61 is adjusted on the basis of the types of sheets (the type of envelope sheet and the type of content sheet) and the number of overlapping of sheets (the type of fold of content sheet and the number of content sheets). However, the protruding amount of the stiffness enhancing member 61 may be adjusted on the basis of one of the types of sheets or the number of overlapping of sheets.

Moreover, the first and second embodiments have shown the configuration where each inclined portion 47, which is a member protruding from the guide plate 37, is integrated with the striking portion 46. However, the configuration may be such that the member protruding from the guide plate 37 is separated from the striking portion. In this case, the positions, in the direction of sheet transfer, of the member protruding from the guide plate 37 and the stiffness enhancing members 40 and 61, which are members protruding from the guide plate 36, may not have to be positions in the leading end portion of the sheet receiving unit 31. However, these protruding members should be arranged at positions where the protruding members do not form any curve in the width direction on the sheets near the introducing port of the sheet receiving unit 31 where the bent portion to be folded by the main folding roller 51 and the discharging roller 53 is formed. The curve forming unit is only required to form a curved portion, in the width direction, on the sheets introduced in the sheet receiving unit 31 at a position which is closer to the leading ends of the sheets than is the position where the bent portion to be folded by the main folding roller 51 and the discharging roller 53 is formed.

Moreover, in the first embodiment, instead of the inclined portion 47, which is a member protruding from the guide plate 37, it is possible to use one that is independent of the striking portion and formed of a member having flexibility like the stiffness enhancing member 40.

Moreover, in the second embodiment, instead of the inclined portion 47, which is a member protruding from the guide plate 37, it is possible to use one that is independent of the striking portion and capable of adjusting the protruding amount like the stiffness enhancing member 61.

Moreover, in the first and second embodiments, there are two inclined portions 47, which are members protruding from the guide plate 37, and they are arranged away from each other in the width direction, and there is one stiffness enhancing member 40, 61, which is a member protruding from the guide plate 36, and it is arranged between the inclined portions 47. However, the number of members protruding from the guide plate 37 and the number of members protruding from the guide plate 36 are not limited to the above case. Multiple members protruding from the guide plate 37 and multiple members protruding from the guide plate 36 may be arranged alternately in the width direction.

As described above, it is apparent that the present invention includes various embodiments and the like that are not described herein. Therefore, the technical scope of the present invention shall be determined solely by the specified matters in the invention according to the claims that are regarded appropriate from the above description.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A sheet folding device, comprising:

a sheet receiving unit comprising a pair of guide plates configured to restrict opposite sides, in a thickness direction, of one or a plurality of stacked sheets introduced into the sheet receiving unit and a striking portion configured to be struck by leading ends of the sheets as introduced;

a roller group configured to introduce the sheets into the sheet receiving unit, strike the sheets as introduced on the striking portion to form a bent portion on the sheets, and nip and fold the bent portion as formed and discharge the sheets from the sheet receiving unit; and a curve forming unit configured to form a curved portion on the sheets introduced in the sheet receiving unit, at a position closer to the leading ends of the sheets than a position where the bent portion to be folded by the roller group is formed, the curved portion being curved in a width direction perpendicular to a direction of transfer of the sheets, wherein the curve forming unit comprises:

at least one first protruding member protruding from one of the pair of guide plates toward the other guide plate by a first protruding amount, and having an inclined surface that becomes closer to the other guide plate as the at least one first protruding member extends toward a downstream side in the direction of transfer of the sheets; and at least one second protruding member protruding from the other guide plate toward the one guide plate by a second protruding amount, and having an inclined surface that becomes closer to the one guide plate as the at least one second protruding member extends toward the downstream side in the direction of transfer of the sheets, wherein the at least one first protruding member and the at least one second protruding member are arranged alternately at an interval in the width direction.

2. The sheet folding device according to claim 1, wherein at least one of the at least one first protruding member or the at least one second protruding member has flexibility.

3. The sheet folding device according to claim 1, further comprising:

an adjusting unit configured to adjust at least one protruding amount of the first protruding amount or the second protruding amount; and a controlling unit configured to control the adjusting unit to adjust the at least one protruding amount on a basis of at least one of a type of the sheets or a number of overlapping of the sheets to be introduced into the sheet receiving unit.

4. The sheet folding device according to claim 1, wherein the curve forming unit is provided at a position closer to the striking portion than the roller group.

* * * * *